United States Patent [19]

Hosaka

[11] 4,419,976

[45] Dec. 13, 1983

[54] FUEL INJECTION CONTROL SYSTEM

[75] Inventor: Akio Hosaka, Yokohama, Japan

[73] Assignee: Nissan Motor Company, Limited, Yokohama, Japan

[21] Appl. No.: 246,894

[22] Filed: Mar. 23, 1981

[30] Foreign Application Priority Data

Mar. 24, 1980 [JP] Japan ..... 55-36260

[51] Int. Cl.[3] ..... F02D 5/02; F02M 51/00

[52] U.S. Cl. ..... 123/458; 123/463

[58] Field of Search ..... 123/458, 459, 463, 478, 123/491, 492

[56] References Cited

U.S. PATENT DOCUMENTS

| | | | |
|---|---|---|---|
| 3,820,517 | 6/1974 | Nambu | 123/478 X |
| 4,034,721 | 7/1977 | Lenzi et al. | 123/459 X |
| 4,175,528 | 11/1979 | Mennesson | 123/463 X |
| 4,200,063 | 4/1980 | Bowler | 123/478 |

FOREIGN PATENT DOCUMENTS

| | | | |
|---|---|---|---|
| 53-20024 | 2/1978 | Japan | 123/458 |
| 1320187 | 6/1973 | United Kingdom . | |
| 1323134 | 7/1973 | United Kingdom . | |
| 1355921 | 6/1974 | United Kingdom . | |
| 1386172 | 3/1975 | United Kingdom . | |
| 1448567 | 9/1976 | United Kingdom . | |
| 1546074 | 5/1979 | United Kingdom . | |

*Primary Examiner*—Tony M. Argenbright

*Attorney, Agent, or Firm*—Schwartz, Jeffery, Schwaab, Mack, Blumenthal & Koch

[57] ABSTRACT

A fuel injection control system for an internal combustion engine including a sensor unit for detecting at least one engine operating condition, at least one fuel injection valve for supplying fuel to the engine, and a regulator for maintaining the pressure across the fuel injection valve at one of a set of values. A control unit is provided for controlling the fuel injection valve and the regulator in response to the output signal of the sensor unit in such a way as to change the regulated value of the pressure according to the engine operating conditions while keeping the amount of fuel injected constant.

9 Claims, 4 Drawing Figures

FUEL INJECTION CONTROL SYSTEM

BACKGROUND OF THE INVENTION

This invention relates to a fuel injection control system for an internal combustion engine and more particularly to an electronically controlled fuel injection system wherein the fuel injection pressure of an injection valve is changed in response to engine operating conditions.

In the prior art electronically controlled fuel injection systems for internal combustion engines, a fuel injection valve for supplying fuel into an intake passage is operated by a control signal depending mainly upon the intake air flow rate Q and the engine rotation speed N. In order to maintain the air-fuel ratio of the mixture to the engine cylinders at a required value, the control signal usually takes a form of a pulse train which is synchronized with the engine rotation and whose pulse width corresponds to the period of fuel injection and is proportional to the value Q/N while the pressure across the fuel injection valve is kept constant.

Since the response time of the opening of a fuel injection valve generally varies considerably and in a manner as a function of the voltage of the control signal, the error in the amount of injected fuel due to voltage variations in the control signal increases in the region where a relatively small amount of is to be fuel injected, especially where the injection valve opening period is relatively short as compared to the response time of the injection valve.

Accordingly, in the prior art fuel injection systems, to reduce the error in the amount of injected fuel, the constant value of pressure across the fuel injection valve has been made comparatively small in order to increase the valve opening period relative to its response time. On the other hand, the maximum amount of injected fuel which can be obtained when the injection valve is always open, is then limited to a relatively small valve, which reduces the controllable range of the amount of injected fuel. Thus such fuel injection systems may be difficult to apply to an engine such as a turbo-supercharged engine which requires a relatively large controllable range for the amount of injected fuel.

SUMMARY OF THE INVENTION

It is an object of this invention to provide a fuel injection control system for an internal combustion engine which has a comparatively large control range for the amount of injected fuel.

It is another object of this invention to provide a fuel injection control system for an internal combustion engine which has a comparatively large control range for the amount of injected fuel and which controls the amount of injected fuel precisely.

This invention provides a fuel injection control system for an internal combustion engine, including a sensor unit detecting at least one engine operating condition, at least one fuel injection valve to supply fuel to the engine, and a regulator for maintaining the fuel pressure across the fuel injection valve at one of a set of values.

Additionally a control unit is provided for controlling the fuel injection valve and the regulator in response to the output signal for the sensor unit in such a way as to change the regulated value of the pressure according to the engine operating conditions while keeping the amount of injected fuel constant on changing the pressure.

The above and other objects, features and advantages of this invention will be apparent from the following description of preferred embodiments thereof, taken in conjunction with the drawings.

DESCRIPTION OF THE PREFERRED EMBODIMENTS

Figure 1:
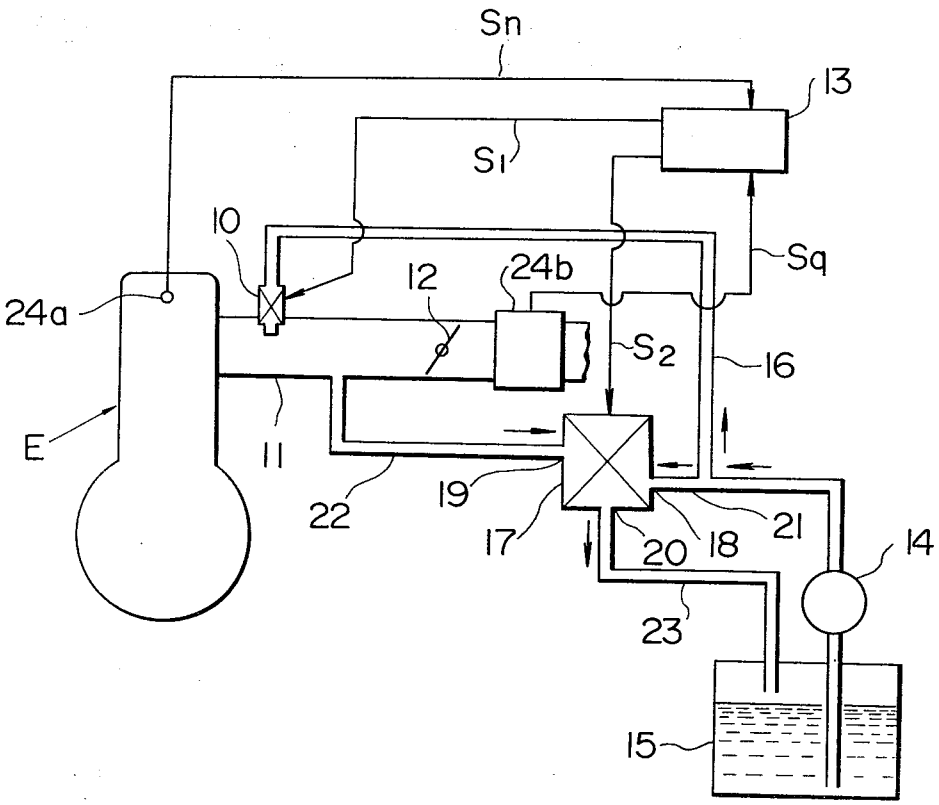
FIG. 1 is a schematic view of a fuel injection control system embodying the present invention.

Referring to FIG. 1, there is shown a fuel injection control system having a fuel injection valve 10, which injects fuel into an intake passage 11 downstream of a throttle valve 12 to supply fuel along with intake air to an internal combustion engine E. The fuel injection valve 10 opens and injects fuel when energized, and is driven by a control signal $S_1$ from a control unit 13. A pump 14 supplies fuel from a fuel tank 15 to the injection valve 10 through a line 16. Additionally, a pressure regulator 17 is provided for maintaining the pressure supplied to the fuel injection valve 10 at one of a set of predetermined values. This pressure, namely the difference between the pressure of the fuel supplied to the injection valve 10 and the pressure in the intake channel 11 into which fuel is injected, is referred to as fuel injection pressure $P_i$ hereinafter. The predetermined value of the pressure is changed by a control signal $S_2$ from the control unit 13.

The regulator 17 has two inlets 18, 19 and an outlet 20. The inlet 18 communicates with the line 16 through a line 21, and the other inlet 19 communicates with the intake passage 11 downstream of the throttle valve 12 but upstream of the fuel injection valve 10 through a line 22. The outlet 20 communicates with the fuel tank 15 through a line 23.

The control unit 13 consists of a microcomputer system which contains a central processor, a random access memory, a read only memory, and an input/output circuit. The control unit 13 outputs control signals $S_1$ and $S_2$ in response to signals $S_n$ and $S_q$ representing the number of engine revolutions N (per second or minute), that is engine rotation speed, and the amount of intake air Q (per second or minute), that is intake air flow rate, respectively.

The signal $S_n$ is transmitted from a sensor 24*a* mounted on the engine E to detect electrically the engine rotation speed N, and the signal $S_q$ is transmitted from an air flow meter 24*b* disposed in the intake passage 11 to detect electrically the intake air amount Q. Additionally, other sensors (not shown) are provided for electrically detecting engine temperature, engine starting, and so on, and sending these items of information on engine conditions to the control unit 13.

The control signal $S_1$ is formed in the control unit 13 so as to take the form of a pulse train which is synchronized with the engine revolution and whose pulse width T is basically proportional to the value Q/N. Thus, the frequency of the control signal $S_1$ is proportional to or same as the engine rotation speed N and the fuel injection valve 10 opens and injects fuel while receiving the pulses, so that the amount of injected fuel is basically proportional to the amount of intake air provided that the fuel injection pressure $P_i$ is kept constant. The basic ratio of the amount of intake air to injected fuel is preset to a required value.

Figure 2:
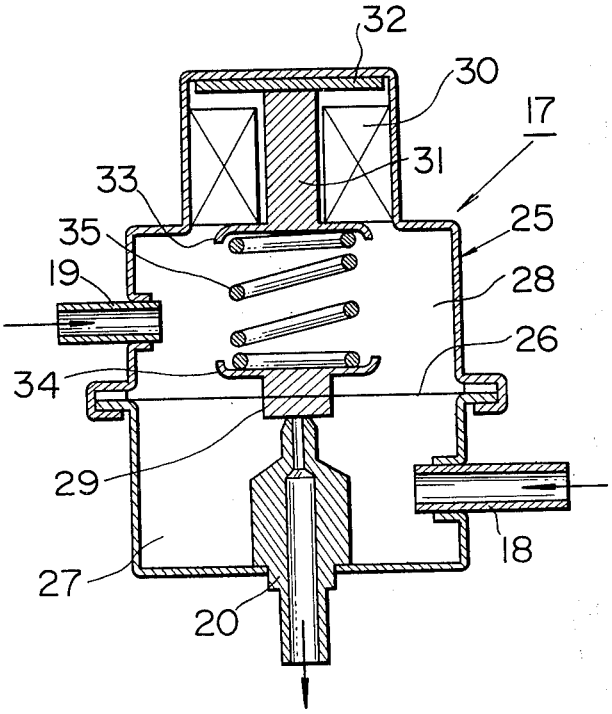
FIG. 2 is a detailed cross-sectional view of the pressure regulator of FIG. 1.

FIG. 2 illustrates the pressure regulator 17 in more detail, including a casing 25 composed of two halves between which a diaphragm 26 is clamped at its outer periphery to form therewith lower and upper chambers 27 and 28. The inlet 18 and the line 21 connect the lower chamber 27 to the line 16 to admit pressurized fuel from the pump 14 and thus to introduce the pressure of the fuel supplied to the injection valve 10 into the lower chamber 27. The inlet 19 and the line 22 connect the upper chamber 28 to the intake passage 11 to introduce the pressure in the intake passage 11 into the upper chamber 28. The outlet 20 extends through the casing bottom wall into the lower chamber 27 and terminates close to the center of the diaphragm 26. A valve member 29 is attached to the center of the diaphragm 26 to open and close the outlet 20 by moving away from and toward the outlet 20. Since the outlet 20 communicates with the fuel tank 15 under low pressure via the line 23, the amount of fuel returned to the tank 15 through the outlet 20 increases and thus the pressure of the fuel supplied to the injection valve drops as the valve member 29 opens and moves away from the outlet 20. A solenoid 30, through which a rod 31 extends, is disposed in the upper chamber 28. The rod 31 has a magnetic material 32 at its top end and a spring seat 33 at its bottom end. The valve member 29 has a corresponding spring seat 34 at its top end to receive a spring 35, which is placed between these seats 33, 34 to urge the valve member 29 toward the outlet 20. The solenoid 30 also urges the valve member 29 toward the outlet 20 through the spring 35 when it is energized by the control signal $S_2$, since the magnetic material 32 is attracted by the solenoid 30, forcing the rod 31 toward the outlet 20.

The valve member 29 along with the diaphragm 26 moves away from or toward the outlet 20 in response to the difference between the pressures in the chambers 27, 28, namely the fuel injection pressure $P_i$. If the fuel injection pressure $P_i$ rises, the valve member 29 moves away from the outlet 20 and increases the amount of fuel returned to the fuel tank 15, thereby reducing the fuel injection pressure $P_i$ until it returns to the set value. If, however, the fuel injection pressure $P_i$ drops, the valve member 29 moves toward the outlet 20, raising the fuel injection pressure $P_i$ until equilibrium is reached. Thus the fuel injection pressure $P_i$ is maintained at a predetermined value, which is increased when the solenoid 30 is energized since the force acting on the valve member 29 is varied with activation of the solenoid 30. The solenoid 30 is activated by the control signal $S_2$ from the control unit 13. In this embodiment, the control signal $S_2$ has two different voltage states, "on" and "off," so that the value of the fuel injection pressure $P_i$ switches from the lower value $P_1$ to higher value $P_2$ when the control signal $S_2$ turns from "off" to "on". The ratio of the higher value $P_2$ ($=mP_1$) to the lower value $P_1$ is predetermined by selecting the voltage of the control signal $S_2$ and the strength of spring 35 suitably.

Figure 3:
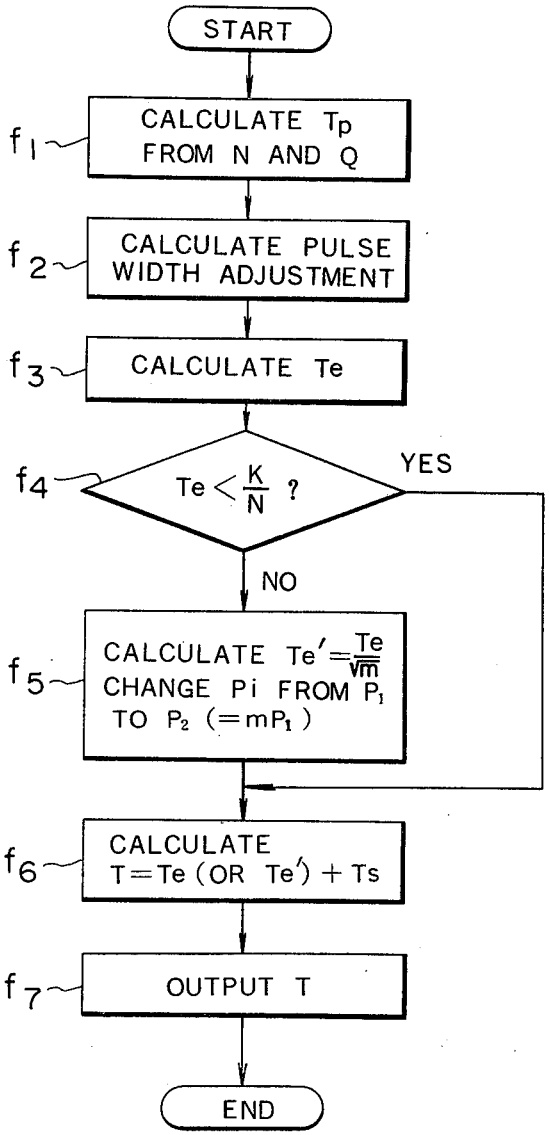
FIG. 3 is a flowchart for the control unit of FIG. 1.

FIG. 3 is a flowchart for the operation of the control unit 13. The operation is carried out repeatedly and is synchronized with either the engine rotation or a constant frequency signal. In step $f_1$, a basic pulse width $T_p$ is calculated from the engine rotation speed N and the rate of air intake Q so as to be proportional to the value Q/N. In step $f_2$ pulse width adjusting values are calculated from the information on engine temperature, engine starting, and so on. These pulse width adjusting values are added to the basic pulse width $T_p$ in step $f_3$ to produce an adjusted pulse width $T_e$ for correcting the amount of injected fuel in response to engine operating conditions such as engine temperature or engine starting. Step $f_4$ determines whether the adjusted pulse width $T_e$ is smaller than a value K/N, where K is a constant. In other words, step $f_4$ determines essentially whether the rate of air intake Q is smaller than the predetermined value $Q_o$, since the adjusted pulse width $T_e$ is basically proportional to the value Q/N. If the answer to step $f_4$ is "no," in step $f_5$ the adjusted pulse width $T_e$ is reduced by dividing the valve $T_e$ by $\sqrt{m}$ to make a new adjusted pulse width $T_e'$ while the control signal $S_2$ is changed from "off" to "on" to raise the fuel injection pressure $P_i$ from the value $P_1$ to $P_2$. Since $P_2=mP_1$, the amount of injected fuel is unchanged across the boundary $T_e=K/N$ although the fuel injection pressure $P_i$ is changed. In step $f_6$, the new adjusted pulse width $T_e'$ is added to a correcting pulse width $T_s$ to allow for voltage variation of the control signal $S_1$ to obtain a final pulse width T of the signal $S_1$. On the other hand, if the answer to step $f_4$ is "yes," the adjusted pulse width $T_e$ is directly added to the correcting pulse width $T_s$ in step $f_6$ to obtain the final pulse width T of the signal $S_1$. In step $f_7$ the final pulse width T is outputted, thereby making the pulse width of the control signal $S_1$ equal to the pulse width T.

Thus, the controllable range of the amount of injected fuel is greatly increased by allowing a change in fuel injection pressure $P_i$. Moreover the control of the amount of injected fuel can be performed precisely even in the region where the fuel injection amount is relatively low, since the pulse width T may be relatively increased and consequently the ratio of the injection valve opening period to the response time of the injection valve 10 is also increased.

Figure 4:
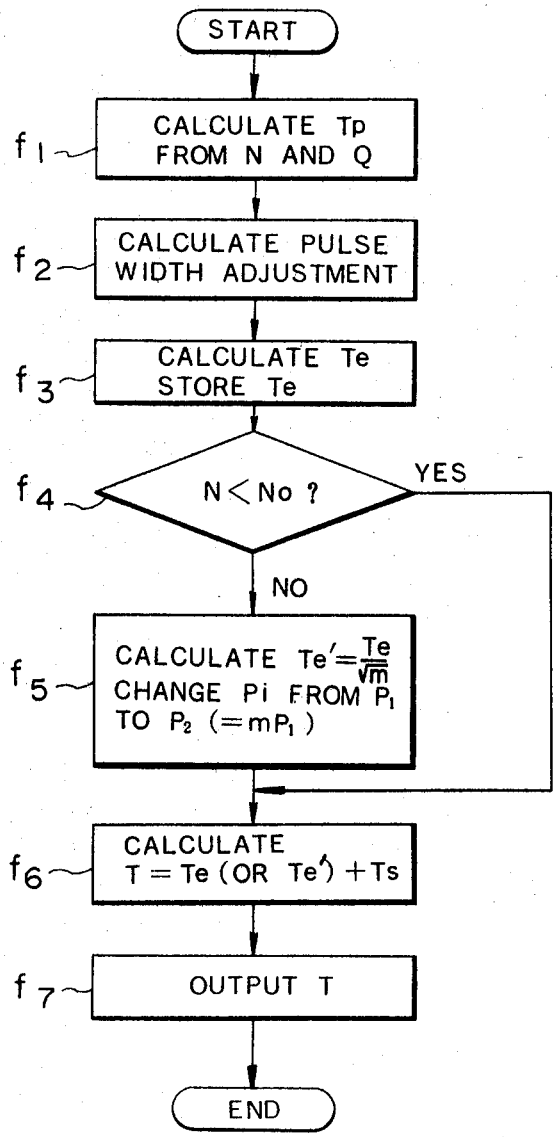
FIG. 4 is an alternative flowchart for the control unit of FIG. 1.

FIG. 4 is an alternative flowchart for the operation of the control unit 13. This operation is similar to that shown in FIG. 3 except for the following points. In step $f_3$, after calculation of $T_e$, the adjusted pulse width $T_e$ is stored in a random access memory (RAM). Step $f_4$ determines whether the engine rotation speed N is less than a predetermined value $N_o$ for example 3,000 rpm.

Thus the fuel injection pressure $P_i$ and the pulse width are changed in response to the engine rotation speed N.

It will be understood by those skilled in the art that the foregoing description is made in terms of a preferred embodiment of the present invention wherein various changes and modifications may be made without departing from the spirit and scope of the invention, as set forth in the appended claims.

What is claimed is:

1. A fuel injection control system for an internal combustion engine, comprising:

(a) a sensor unit for detecting at least one engine operating condition and generating a signal indicative thereof;

(b) at least one intermittently opening fuel injection valve for supplying fuel to the engine;

(c) a regulator for maintaining the pressure across the fuel injection valve switchably at any one of a set of at least two different predetermined values; and (d) a control unit for controlling the fuel injection valve and the regulator in response to the signal from the sensor unit to switch the pressure across the fuel injection valve from one to another of said predetermined values in accordance with the engine operating condition while maintaining the amount of fuel injected during each opening of the fuel injection valve independent of said switching of the regulated pressure.

2. The fuel injection control system of claim 1, in which the regulator includes a diaphragm separating first and second chambers, the first chamber being connected to an intake passage of said internal combustion engine, the second chamber being supplied with fuel pressure from upstream of the fuel injection valve, a valve for controlling the relief of the pressure upstream of the fuel injection valve, the valve being operated by the diaphragm, a magnetic material connected to the control valve, and a solenoid to selectively attract the magnetic material to move the control valve, whereby the diaphragm moves and operates the control valve in response to the pressure across the fuel injection valve to maintain said pressure at a changed value in accordance with activation of the solenoid.

3. The fuel injection control system of claim 2, in which the sensor unit includes first and second sensors detecting engine rotation speed N and intake air flow rate Q respectively as engine operating conditions.

4. The fuel injection control system of claim 3, in which the control unit controls the regulator to maintain the pressure across the fuel injection valve at a first value $P_1$ in the region where the intake air flow rate Q is smaller than a predetermined value $Q_o$, and at a second value $P_2$ greater than the first value $P_1$ in the region where the value Q is equal to or greater than the value $Q_o$.

5. The fuel injection control system of claim 3, in which the control unit controls the regulator to maintain the pressure across the fuel injection valve at a first value $P_1$ in a region where the engine rotation speed N is less than a predetermined value $N_o$, and at a second value $P_2$ greater than the first value $P_1$ in a region where the value N is equal to or greater than the value $N_o$.

6. The fuel injection control system of claim 5, in which the control unit controls the fuel injection valve by using a pulse train which is synchronized with the engine rotation and whose pulse width T is basically proportional to the value Q/N, and the fuel injection valve opens when energized.

7. The fuel injection control system of claim 6, in which the pulse width is divided by the value $\sqrt{P_2/P_1}$ when the pressure across the injection valve is changed from the values $P_1$ to $P_2$ so as to keep the amount of injected fuel constant.

8. A fuel injection control system for an internal combustion engine, comprising:

(a) a sensor unit for detecting the intake air flow rate of the engine and for generating a signal indicative thereof;

(b) at least one intermittently opening fuel injection valve for supplying fuel to the engine;

(c) a regulator for maintaining the pressure across the fuel injection valve switchably at any one of a set of at least two different predetermined values; and (d) a control unit for controlling the fuel injection valve and the regulator in response to the signal from the sensor unit to switch the pressure across the fuel injection valve from one to another of said predetemrined values in accordance with the intake air flow rate while maintaining the amount of fuel injected during each opening of the fuel injection valve independent of said switching of the regulated pressure.

9. A fuel injection control system for an internal combustion engine, comprising: pg,20

(a) a sensor unit for detecting the rotational speed of the engine and for generating a signal indicative thereof;

(b) at least one intermittently opening fuel injection valve for supplying fuel to the engine;

(c) a regulator for maintaining the pressure across the fuel injection valve switchably at any one of a set of at least two different predetermined values; and (d) a control unit for controlling the fuel injection valve and the regulator in response to the signal from the sensor unit to switch the pressure across the fuel injection valve from one to another of said predetermined values in accordance with the engine rotational speed while maintaining the amount of fuel injected during each opening of the fuel injection valve independent of said switching of the regulated pressure.

* * * * *